United States Patent [19]

Weinar

[11] 4,296,580

[45] Oct. 27, 1981

[54] WALL CONSTRUCTED FROM PANELS HELD IN POSITION WITH THE AID OF CONCEALED FASTENERS AND CONCEALABLE FASTENERS FOR USE IN ASSEMBLING SUCH WALL

[76] Inventor: Roger N. Weinar, 19 Parkside Ave., Hamburg, N.Y. 14075

[21] Appl. No.: 171,331

[22] Filed: Jul. 23, 1980

Related U.S. Application Data

[63] Continuation-in-part of Ser. No. 947,078, Sep. 29, 1978, Pat. No. 4,221,095, which is a continuation-in-part of Ser. No. 736,425, Oct. 28, 1976, Pat. No. 4,117,644.

[51] Int. Cl.[3] ..... E04B 1/00

[52] U.S. Cl. ..... 52/281; 52/489; 52/509; 52/714

[58] Field of Search ..... 52/481, 489, 281, 714, 52/483, DIG. 6, 509, 715

[56] References Cited

U.S. PATENT DOCUMENTS

| | | | |
|---|---|---|---|
| 2,281,519 | 4/1942 | Faber | 52/489 X |
| 2,831,222 | 4/1958 | Anderson | 52/489 |
| 3,047,985 | 8/1962 | Murphy | 52/483 |
| 3,308,590 | 3/1967 | Ettore et al. | 52/281 |
| 4,052,831 | 10/1977 | Roberts et al. | 52/363 X |
| 4,221,095 | 9/1980 | Weinar | 52/489 |

*Primary Examiner*—Price C. Faw, Jr.
*Assistant Examiner*—Carl D. Friedman
*Attorney, Agent, or Firm*—Raymond F. Kramer

[57] ABSTRACT

Mechanically held fasteners or clips invisibly secure common end-abutting wallboard panels to common wood or metal framing members. The fasteners are spaced apart, extending from the backs of wallboard panels and beyond their vertical ends so as to be conveniently screw fastened to a framing member. When screw fastened to common wall framing members, the clips, due to their spacing structure, which also improves clip strength, secure the wallboard panels slightly off the framing member front surface to permit offset fasteners of abutting wallboard panels to slide between the fastened wallboard panels and the framing members and to be engaged by the fastened wallboard panels in a "tongue and groove" relationship, preventing transverse panel movement.

22 Claims, 6 Drawing Figures

WALL CONSTRUCTED FROM PANELS HELD IN POSITION WITH THE AID OF CONCEALED FASTENERS AND CONCEALABLE FASTENERS FOR USE IN ASSEMBLING SUCH WALL

This application is a continuation-in-part of application Ser. No. 947,078 filed Sept. 29, 1978 now U.S. Pat. No. 4,221,095 issued Sept. 9, 1980, which is a continuation-in-part of application Ser. No. 736,425 filed Oct. 28, 1976 now U.S. Pat. No. 4,117,644 issued Oct. 3, 1978.

This invention relates to wallboard construction and to an improvement in the practice of supporting pre-finished wallboard panels on ordinary framing members, such as wood or metal studs and furring runners. Prefinished wallboard panels are available from many sources in a wide variety of colors and textures, the most common being vinyl surfaced gypsum boards or drywall panels. Various methods have been used to secure these pre-finished panels to ordinary framing members, a prior preferred practice being to secure each sheet perimeter with self-drilling screw fasteners. Such method holds the panels securely but requires a decorative cover or batten strip to conceal the unsightly screw heads along the exposed panel joints. A more aesthetically pleasing but more difficult construction method utilizes an adhesive to invisibly secure the wallboard panels to ordinary wood or metal framing members. This method eliminates the batten strips but elaborate bracing devices are required to temporarily secure the panels while the adhesive cures. The adhesive method is desirable for unobstructed joint surface appearance but the installation is highly labor intensive and the panels are difficult to remove without damage.

Many so-called "movable" or "demountable" partition systems are available which utilize pre-finished wallboard panels modified with various fastening devices, but such systems require unique or specially manufactured framing members of more or less elaborate configuration. These special, single purpose framing members are not as readily available as competitively priced ordinary wood or metal studs and furring, and expensive inventories are required for installation and maintenance of these special systems.

In accordance with the present invention there are provided walls made from wallboard assembled with special fasteners, such as those described in my U.S. Pat. No. 4,117,644, and fasteners of equivalent and similar structures. Such walls and/or partitions may comprise first and second coplanar end-abutting panels, substantially invisibly secured together along a joinder line at a wall framing member by a first series of a plurality of spaced apart fasteners joined to the first panel at the abutting end thereof and held to the framing member, and a second series of spaced apart fasteners joined to the second panel at the abutting end thereof and with parts of each of the fasteners of each of both series of fasteners extending parallel to said panels at concealed back major surfaces thereof, said fasteners of the second series of fasteners being so located as to avoid contact with said fasteners of the first series of fasteners, and said extending parts of said fasteners of the second series of fasteners, when the wallboard panels are in coplanar end-abutting relationship, contacting the back major surface of the first panel and, in conjunction with the framing member, the first series of fasteners, means for holding the fasteners of the first series to the framing member and the first panel, preventing said second panel from moving away from said framing member and from said first panel in a direction having a component at right angles to the plane of the panels, which fasteners of the first series are each comprised of directly connected plate and tongue portions which are essentially flat, with the plate portion contacting the first panel and the tongue portion contacting the second panel, a pair of web portions extending only from the plate portion and installed between first and second panel ends, a pair of impaling portions extending from said web portions and overlying said plate portion and penetrating said first panel at an abutting end thereof, a framing contacting part of the fastener, and a panel contacting part of the fastener, with such framing contacting and panel contacting parts being connected by a wall member or plurality of wall members, which space(s) them apart and strengthen(s) the fastener, and which fasteners of the second series are of the same structure as those of the first series. Expressed somewhat differently, the invented wall or partition comprises first and second coplanar end-abutting panels, invisibly secured together along a joinder line at a wall framing member by a first series of a plurality of spaced apart fasteners joined to the first panel at the abutting end thereof and held to the framing member, and a second series of spaced apart fasteners joined to the second panel at the abutting end thereof and with parts of each of the fasteners of each of the series of fasteners extending parallel to said panel at the concealed back major surfaces thereof, said fasteners of the second series of fasteners being so located as to avoid contact with said fasteners, of the first series of fasteners, and said extending parts of said fasteners of the second series of fasteners, when the wallboard panels are in coplanar end-abutting relationship, contacting the back major surface of the first panel and, in conjunction with the framing member, the first series of fasteners, means for holding the fasteners of the first series to the framing member, and the first panel, preventing said second panel from moving away from said framing member and from said first panel in a direction having a component at right angles to the plane of the panels, which fasteners of the first series are each formed from a single sheet of temperable metal and include a substantially T-shaped fastening and spacing structure at the backs of the wallboard, when installed, exposed to the wall cavity formed at least in part by the wallboards and the framing members, having in a plane a surface or surfaces of a panel abutting part or a plurality of such parts and in a parallel plane a surface or surfaces of a framing abutting part or a plurality of such parts, said planes being spaced apart by intermediate rigidizing walls of the fasteners, with the fasteners of the first series having arms of the T, or the cross-bar thereof, disposed behind the first wallboard panel and the leg of the T extending beyond said first panel end and mechanically fastened to the framing member and with the arms of the T each having spaced web portions extending perpendicular thereto, between the ends of abutting wallboard panels, and panel piercing portions extending from said web portions, parallel to and partially covering the arms of the T and within the body of the wallboard panel at the end thereof, and which fasteners of the second series are of the same structure as those of the first series. Also within the invention are the fasteners or clips utilized in assembling such walls.

The wallboard fasteners employed are useful for holding a first wallboard panel to a framing member at an end thereof and for joining to a second wallboard panel to be installed coplanar with and having an end thereof abutting the held end of the first panel, so that parts of said fasteners, on installation of the second wallboard, contact the first panel, to which said fasteners are not joined, and prevent transverse movements of the second panel. Such fasteners preferably comprise single pieces of temperable or heat treatable sheet metal, each having a substantially flat plate portion, a tongue portion extending from the plate portion and coplanar therewith, a pair of web portions, one on each side of the tongue portion and each extending at a right angle from said plate portion and an impaling flange portion extending from each web portion in the same direction, essentially parallel to and overlying said plate portion and opposite to the direction in which the tongue extends so that the plate portion may contact the surface of the wallboard panel while the impaling flange portion is impaling said panel at an end thereof. Said fasteners preferably include a wall depressed area in the tongue portion, more preferably in both plate and tongue portions, with a longitudinal slot in the tongue portion or both such portions, and with the depression being in a direction opposite to that in which the webs extend. Preferably the fasteners have no impaling portions extending in the direction of the tongue portion and are free of webs extending beyond the depression from the tongue and from the plate portions in the direction the depression extends from such portions.

However, although slots are highly preferable, allowing more convenient installation of the clips to be fastened to a framing member, enlarged holes may also allow adjustability of positioning and knurls or other marks or impressions may facilitate drilling of such a hole or driving a fastener through the clip at a desired location. Also, some of the important advantages of the invention are realizable without the use of such openings and impressions. Providing that the spacing planes or equivalent surfaces of the plate are present, to create a clearance between the panel back surface and the stud or other framing member, greater than the thickness of the fastener material, so that the tongue or leg portion of a fastener may be inserted, the present fasteners will be operative. If desired, different depression or embossment shapes may be used and plural depressions or raised surfaces may be provided in the tongue (and plate, too, in many cases) to produce equivalent clearances.

The fasteners are preferably made of a spring steel, such as SAE 1050, which is annealed before forming and after forming is tempered, as by heat treatment, to a Rockwell hardness in the C-24-34 range, more preferably in the C-28-30 range. In such fasteners the depressed area in the plate and tongue portions (or the clearance provided) is of such a depth as to allow the head of a screw or other mounting means passing through the slot in said depressed area or otherwise through the material of the clip, to be below the surface of the tongue portion of the fastener, and the depressed area preferably has a substantially flat bottom and terminates short of the end of the tongue portion, so as to facilitate insertion of tongue portions of fasteners impaled on a second wallboard panel behind a mounted first wallboard panel as the panels are assembled on a wall. Lead-in bends on the tongue ends may be provided but are not required and may be undesirable in some cases.

It is an object of the invention to provide a mechanical fastener which will invisibly secure wallboard and/or partition panels to ordinary wood or metal framing members.

A particular object of this invention is to provide a building structure, such as a wall, wherein fasteners or clips coengageably secure wallboard panels along abutting joints in a tongue-and-groove type relationship.

A further object of the invention is to provide a building structure of the type described wherein the wallboard panels may be removably attached to the supporting framing members.

Yet another object of the inventon is to provide mechanical fasteners that may be joined to common wallboard panels by piercing just prior to installation of the panels.

Further objects and advantages of the invention will be brought out in the drawings and in this description, in which the purpose is to disclose a preferred embodiment of the invention, without placing limitations thereon.

Referring to the accompanying drawings, which are for illustrating purposes only:

Figure 1:
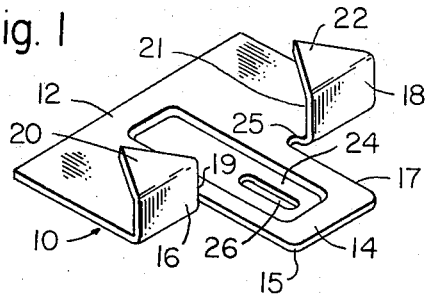
FIG. 1 is an isometric view of a preferred configuration of an impaling fastener of the invention.
Figure 2:
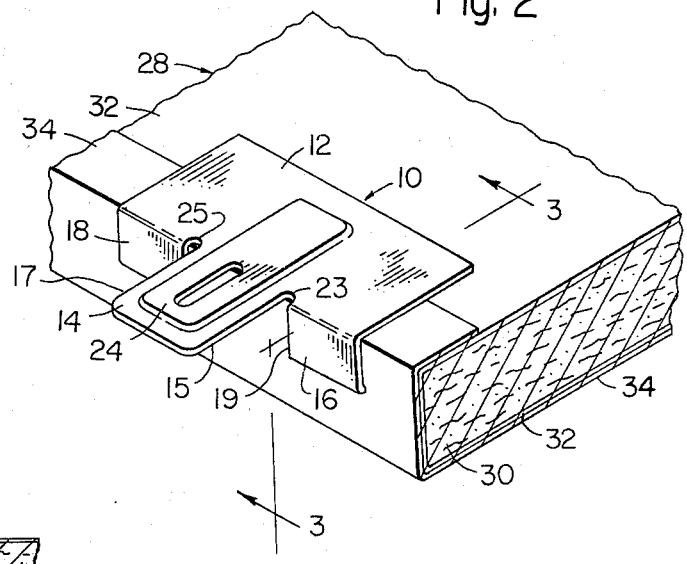
FIG. 2 is a fragmentary isometric view of a wallboard panel with an impaling fastener joined thereto.

Referring to FIG. 1, an impaling fastener 10 is shown formed of a unitary integral sheet of metal, such as spring steel. The fastener 10 is comprised of a plate portion 12, a central tongue portion 14, a pair of web portions 16 and 18, each with a wallboard impaling terminal portion 20 and 22, respectively. A longitudinally axially located flat bottomed and walled depressed area or indentation 24 is struck across plate portion 12 and tongue portion 14 to (a) act as a stiffening rib, (b) increase the effective thickness of the tongue 14 and the plate 12 portions (especially of the plate portions) so as to create a desired clearance, and (c) provide a well for the head of a fastener such as a screw or nail. A longitudinally axially located slot 26 or suitable hole may be provided in this depressed or indented portion 24 of the tongue 14 to facilitate convenient mechanical fastening. Sides 15 and 17 of tongue 14 are spaced apart from sides 18 and 21 of web portions 16 and 19, respectively, so that clearance openings 23 and 25 between the web and the tongue are provided.

Figure 3:
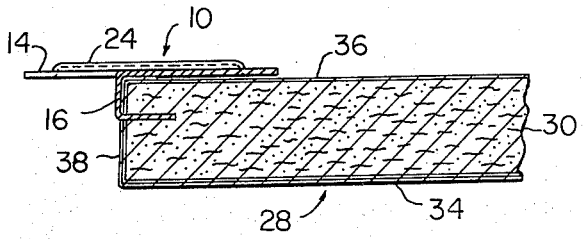
FIG. 3 is a cross-sectional view taken along plane 3—3 of FIG. 2, viewed in the direction of the arrows.

In FIG'S. 2 and 3 the fastener appendant 10 has been installed by impalement on common wallboard panel 28. Such wallboard panels are often comprised of a semi-rigid center composition 30, such as gypsum, an outer wrap 32, such as paper, and a decorative surface cover 34, such as embossed vinyl plastic. In practice, the appendants 10 are installed by impalement on wallboard panels 28 by placing plate portion 12 in firm flat contact with the normally concealed back major surface 36 of wallboard panel 28, as shown in FIG. 3, to cause pointed penetrants 20 and 22 to impale wallboard panel 28 at the approximate midpoint of its end surface 38. The installation of the fastener is easily accomplished by striking web portions 16 and 18 alternately. If desired, a special tool may be used to hold the fastener prior to hammering it into position on the panel.

Figure 4:
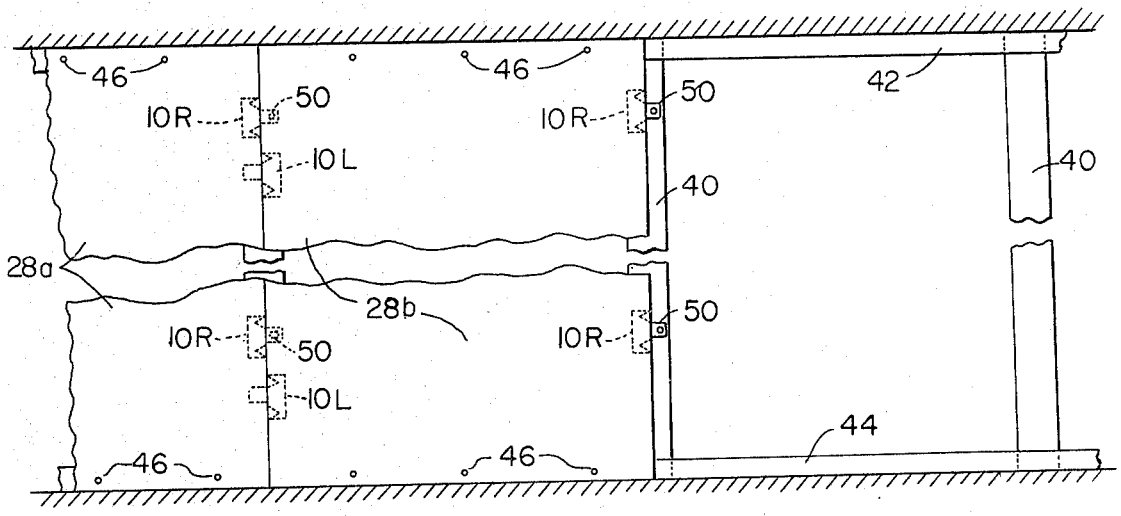
FIG. 4 is a partial elevational view of a wall or partition assembly of this invention, with some of the wallboard panels removed to reveal exposed portions of the fasteners.

For best location of the fastener on each wallboard panel, it has been found to be convenient to pencil or scribe spaced lines on the back side of each such panel along marginal edges at quarter points. This spaces the lines two, four, and six feed distant from the top end of a common eight foot high panel. The fasteners are then installed by impalement slightly above the scribed lines on the left marginal edge, and other clips are installed slightly below the scribed lines on the right marginal edge of each wallboard panel. This fastener layout is desirable to insure the by-passing of opposing fasteners of abutting wallboard panels when vertically erected on the framing members, as illustrated in FIG. 4, which illustrates a typical wall structure or partition of a type of the invention. The wall structure comprises common sheet metal framing members, including laterally spaced apart stud members 40 which have their upper and lower ends frictionally retained in rigid channel shaped runners 42 and 44, mounted on ceiling and floor, respectively, with open channel sides so positioned as to receive the respective ends of the studs.

The wallboard panel erection of the partition in FIG. 4 was begun in a left corner (not shown) and is proceeding sequentially to the right. Wallboard panels **28*a* and 28*b* have been secured to upper and lower channels 42 and 44 by common drywall screws 46. The exposed screw heads are later concealed across the top marginal edge with a common ceiling trim runner (not shown) and concealed along the bottom marginal edge with a common baseboard trim runner (not shown). Only the abutting vertical edges of the wallboard panels are secured with the fastener appendants of this invention. Appendant clips 10R, installed along the right vertical marginal edges of wallboard panels 28*a* and 28*b*, are secured to the vertical stud runners 40 by common sheet metal screws 50. Offset appendant fasteners 10L, impaled along the left vertical marginal edge of wallboard panel 28*b*, are frictionally disposed behind the previously fastened abutting wallboard panel and between it and stud 40** in a tongue and groove relationship.

Figure 5:
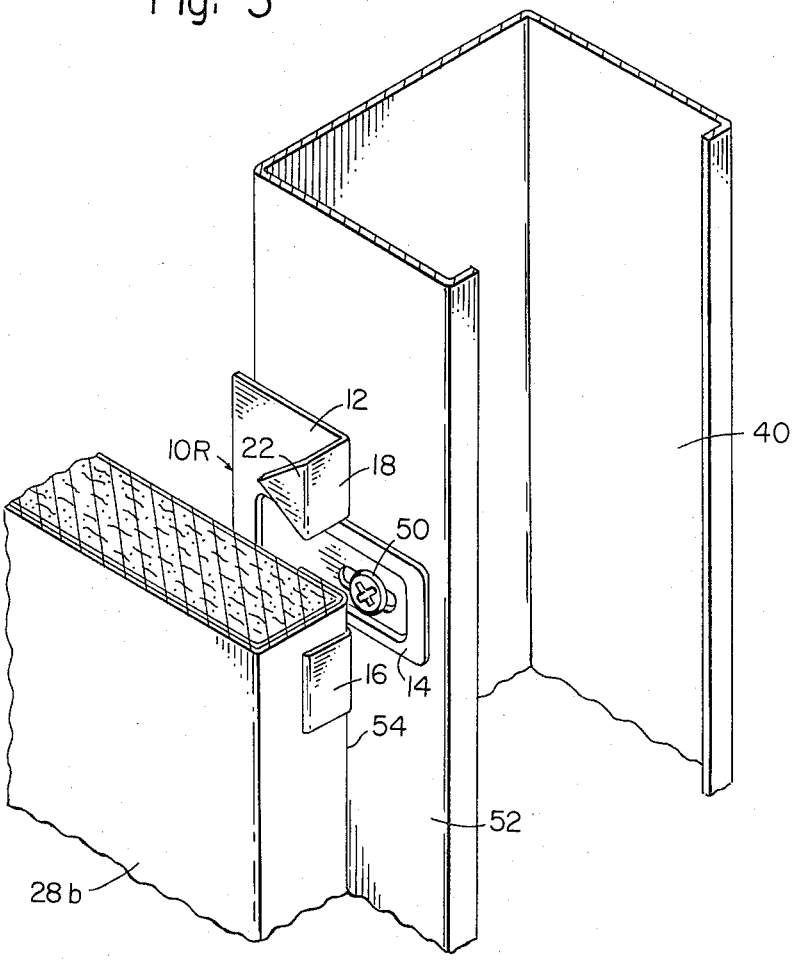
FIG. 5 is a partially cut-away isometric view showing a wallboard panel with the impaling clip fastener secured to a common metal stud framing member by an ordinary self-drilling screw fastener.
Figure 6:
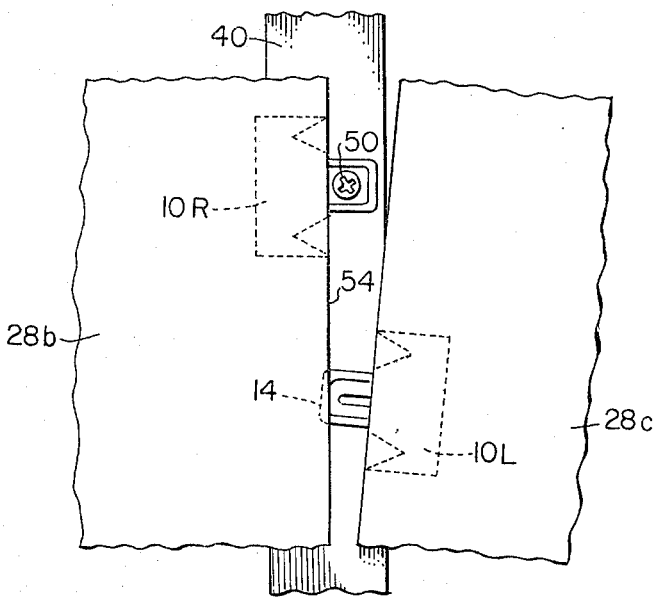
FIG. 6 is a partial elevational view of a wall assembly, illustrating the sequential installation of the coengageable wallboard panels.

The sequence of the panel erection is better illustrated in FIG'S. 5 and 6. In FIG. 5 the wallboard panel **28*b* is cut away to better display the fastener 10R, which is secured to a common sheet metal stud 40 by a common self-drilling screw 50. Wallboard panel 28*b* is rigidly held, slightly off the framing member front surface 52, making clearance, slot or groove 54 between the back surface of the wallboard panel 28*b* and stud 40 and between the fasteners 10R for convenient insertion of offset appendant fasteners 10L of abutting wallboard panel 28*c*, as illustrated in FIG. 6**. It should be noted that the metal stud represents only one of the many common types of framing members and the use of the fasteners of this invention is not limited to framing members of this configuration. On the contrary, a unique advantage of the present screw or nail fastened clip is its ability to work equally well on any flat surfaced wall framing members, whether of wood, metal or other structural material. While fasteners of this invention installed by impalement on common wallboard panels at the job site give excellent results, it is also intended that they may be attached at the wallboard manufacturing plant, with an adhesive or other suitable means, and may be transported with the panels to the job site.

Although it is a feature of this invention that a decoratively covered wallboard is especially usefully held together in a wall structure with concealed fasteners (because the strength of the cover of vinyl or other polymeric or fibrous or cloth material increases the strength of the panel and prevents cracking and crushing of the panel when the fasteners are attached), the present fasteners may also be used with panels of ordinary wallboard, whether of gypsum board, wood, porous polymer, e.g., foamed polyurethane or polyester, or other suitable construction material, and the mentioned advantages are obtainable. Of course, such materials should be malleable or otherwise distortable enough in response to the forces of application so that the impaling points and the adjacent webs may be inserted into and held by the material and will not be objectionally visible after installation. Additionally, it is desirable for the covering (of polyvinyl chloride or other functionally acceptable material) to help to hold the impaling means in position and sometimes it may be useful for the impaling points to have barbed portions thereon to prevent unintentional removal.

In variations of the fasteners illustrated, instead of the impaling points paralleling the plate they may be at an angle to it, usually from 5° to 30°, tending to pinch together or close with the plate. This appears to help to hold the fasteners more tightly to the wallboard. When, instead of a single flat depression, plural depressions (or embossments) are used, they should be essentially flat bottomed, or smoothly curved, so as to bear against a surface next to which they are installed, rather than to penetrate it, and they will be so located, in a balanced disposition, so as to prevent rocking of the fasteners. Normally, the total percentage of the area(s) of such flattened projection(s), with respect to the tongue or tongue plus plate area, on which they may be based, will be from 10 to 90%, preferably 20 to 80%, to provide the desired bearing surface and stability. Within such ranges one may select higher percentages of contact surfaces for softer members against which the fastener is to be brought into contact. Thus, for example, when the stud or framing member is of a plastic foam or soft wood, one may want to use a clip having 40 to 90% contacting surface against such material, with the percentage difference being the percentage of surface contacting a hard wallboard. Conversely, when the board is relatively soft and the framing member is relatively hard the percentages may be reversed or otherwise adjusted for best results. The clearance created by the depression(s) or embossment(s) will preferably be from 1 to 10 mm. more preferably 1 to 3 mm. Four to ten clips, e.g., 4 to 6, are used per wallboard, in normal installations.

In the above description, while the terms "tongue" and "plate" have usually been employed more frequently, the fasteners may also be considered as of T shape, with the leg of the T being the equivalent to the tongue and the arms or cross-bar of the T being equivalent to the plate.

The closest prior art known to applicant which may be relevant to the present invention is that which was cited by the Examiner and applicant in the prosecution of U.S. Pat. Nos. 4,117,644 and 4,221,095 and U.S. patent application Ser. No. 184,961, filed Sept. 8, 1980.

The invention has been described with respect to various embodiments and illustrations thereof but is not to be considered as limited to them because it is evident that one of skill in the art with the present specification before him will be able to utilize substitutes and equivalents without departing from the spirit of the invention.

What is claimed is:

1. A wall or partition comprising first and second coplanar end-abutting panels, substantially invisibly secured together along a joinder line at a wall framing member by a first series of a plurality of spaced apart fasteners joined to the first panel at the abutting end thereof and held to the framing member, and a second series of spaced apart fasteners joined to the second panel at the abutting end thereof and with parts of each of the fasteners of each of both series of fasteners extending parallel to said panels at concealed back major surfaces thereof, said fasteners of the second series of fasteners being so located as to avoid contact with said fasteners of the first series of fasteners, and said extending parts of said fasteners of the second series of fasteners, when the wallboard panels are in coplanar end-abutting relationship, contacting the back major surface of the first panel and, in conjunction with the framing member, the first series of fasteners, means for holding the fasteners of the first series to the framing member, and the first panel, preventing said second panel from moving away from said framing member and from said first panel in a direction having a component at right angles to the plane of the panels, which fasteners of the first series are each comprised of directly connected plate and tongue portions which are essentially flat, with the plate portion contacting the first panel and the tongue portion contacting the second panel, a pair of web portions extending only from the plate portion and installed between first and second panel ends, a pair of impaling portions extending from said web portions and overlying said plate portion and penetrating said first panel at an abutting end thereof, a framing contacting part of the fastener, and a panel contacting part of the fastener, with such framing contacting and panel contacting parts being connected by a wall member or plurality of wall members, which space(s) them apart and strengthen(s) the fastener, and which fasteners of the second series are of the same structure as those of the first series.

2. A wall or partition according to claim 1 wherein the fasteners are each of a single piece of sheet metal, the tongue and plate portions of the fasteners are essentially coplanar, the web portions are at right angles to the plate portion, the impaling flange portions extend from the web portions in the same direction, essentially parallel to the plate portion and partially covering it and the framing contacting portion of the fastener includes one or a plurality of surfaces of walled depressions in the tongue portion, such surfaces being on parts of such depression(s) connecting the wall member(s).

3. A wall or partition according to claim 2 wherein the fasteners are of a temperable sheet metal and are substantially T-shaped, with tongue portions having limiting effective surfaces which are parallel and spaced apart a greater distance than the thickness of the plate by rigidizing walls.

4. A wall or partition according to claim 3 wherein the fasteners are each of heat treated spring steel and the distance between the effective surface planes thereof is such that the tongues of the fasteners of the second series can readily be inserted behind the first panel and will, when the second panel is parallel to the first panel, have at least a portion of each said tongue in contact with the concealed back major surface of the first panel, which is held in place, thereby holding the second panel against transverse movement away from the framing member and maintaining the panels coplanar with respect to each other.

5. A wall or partition according to claim 4 wherein the panels are of wallboard covered on a visible front major surface thereof with a synthetic organic polymeric material.

6. A wall according to claim 5 wherein the wallboard is a gypsum wallboard coated on said front major surface and on a panel-abutting end with a vinyl polymer sheet.

7. A wall according to claim 1 comprising of at least three of panels, with each panel including a first series of fasteners at one end and a second series of fasteners of the same structure at the other end, and with each series comprising at least three such fasteners.

8. A wall according to claim 1 wherein 4 to 10 fasteners of the type described in claim 1 are employed per panel, 2 to 5 on each end of the panel.

9. A wall according to claim 1 wherein the clearance between the back side of a wallboard and a framing member to which it is attached is from 1 to 10 millimeters.

10. A wall according to claim 9 wherein the clearance is from 1 to 3 mm.

11. A wall or partition according to claim 1 wherein the web portions, where they project from the plate portion, are spaced away from the tongue portion.

12. A wall or partition according to claim 11 wherein spacing openings, between the webs and the tongue, are defined by curved walls in the plate portion.

13. A wall or partition according to claim 1 wherein the framing contacting and panel contacting parts of the fastener are so constructed and are sufficiently far apart that a head of a holding screw, nail, rivet or other holding means which passes through the fastener to hold an impaled wallboard to a framing means is within a recess within the fastener wall member or between such wall members so that it does not interfere with the installation of a second wallboard by contact therewith when such second wallboard is being installed.

14. A wall or partition comprising first and second coplanar end-abutting panels, invisibly secured together along a joinder line at a wall framing member by a first series of a plurality of spaced apart fasteners joined to the first panel at the abutting end thereof and held to the framing member, and a second series of spaced apart fasteners joined to the second panel at the abutting end thereof and with parts of each of the fasteners of each of the series of fasteners extending parallel to said panel at the concealed back major surfaces thereof, said fasteners of the second series of fasteners being so located as to avoid contact with said fasteners of the first series of fasteners and said extending parts of said fasteners of the second series of fasteners, when the wallboard panels are in coplanar end-butting relationship, contacting the back major surface of the first panel and, in conjunction with the framing member, the first series of fasteners, means for holding the fasteners of the first series to the framing member, and the first panel, preventing said second panel from moving away from said framing member and from said first panel in a direction having a component at right angles to the plane of the panels, which fasteners of the first series are each formed from a single sheet of temperable metal and include a substantially T-shaped fastening and spacing structure at the backs of the wallboard, when installed, exposed to the wall cavity formed at least in part by the wallboards and the framing members, having in a plane a surface or surfaces of a panel abutting part or a plurality of such parts and in a parallel plane a surface or surfaces of a framing abutting part or a plurality of such parts, said planes being spaced apart by intermediate rigidizing walls of the fasteners, with the fasteners of the first series having arms of the T, or the cross-bar thereof, disposed behind the first wallboard panel and the leg of the T extending beyond said first panel end and mechanically fastened to the framing member and with the arms of the T each having spaced web portions extending perpendicular thereto, between the ends of abutting wallboard panels, and panel piercing portions extending from said web portions, parallel to and partially covering the arms of the T and within the body of the wallboard panel at the end thereof, and which fasteners of the second series are of the same structure as those of the first series.

15. A concealable fastener for holding wallboard panels together in coplanar abutting relationship, substantially invisibly secured together along a joinder line at a wall framing member by a first series of a plurality of spaced apart fasteners joined to a first panel at the abutting end thereof, which is held to a framing member, and a second series of spaced apart fasteners joined to a second panel along the abutting end thereof and with parts of each of the fasteners of each of both series of fasteners extending parallel to said panels at concealed back major surfaces thereof, said fasteners of the second series of fasteners being so located as to avoid contact with said fasteners of the first series of fasteners, and said extending parts of said fasteners of the second series of fasteners, when the wallboard panels are in coplanar edge-abutting relationship, contacting the back side of the first panel and, in conjunction with the framing member and the first panel, preventing said second panel from moving away from said framing member and from said first panel in a direction having a component at right angles to the plane of the panels, which comprises directly connected plate and tongue portions which are essentially flat, with the plate portion capable of contacting the first panel and the tongue portion capable of contacting the second panel, a pair of web portions extending only from the plate portion and installable between first and second panel ends, a pair of impaling flange portions extending from said web portions and partialy covering said plate portion and capable of penetrating said first panel at an abutting end thereof, a part of the plate portion of the fastener which is capable of contacting a framing member, and a part of the plate portion which is capable of contacting an associated wallboard panel, with such framing contacting and panel contacting parts being connected by a wall member of a plurality of wall members which space(s) them apart and strengthen(s) the fastener.

16. A fastener according to claim 15 wherein, in addition to a part of the tongue portion of the installed fastener being capable of contacting the back surface of a wallboard panel, a part of the plate portion is capable of contacting the back surface of an abutting wallboard panel.

17. A fastener according to claim 16 wherein the total area of the parts of the fastener tongue capable of contacting the back surface of a wallboard and of the fastener plate capable of contacting the back surface of an abutting wallboard is within the range of 10 to 90% of the area of one side of te tongue plus one side of the plate.

18. A concealable fastener according to claim 15 wherein the plate and tongue portions are continuous and substantialy coplanar, with the plate portion being wider than the tongue portion and being a direct unitary extension of the tongue portion.

19. A concealable fastener according to claim 15, made entirely from a single piece of temperable sheet steel, which is tempered after formation of the fastener, with the web portions and the impaling flange portions of the fastener extending from said web portions being of steel initially alongside the steel of the tongue portion before formation of the fastener from the temperable sheet steel.

20. A fastener according t claim 15 made entirely from a single piece of sheet metal, with the web portions and the impaling flange portions extending from said web portions being of metal which initially was alongside the metal of the tongue portion, before formation of the fastener from the sheet metal.

21. A fastener according to claim 9 which is of tempered steel.

22. A wallboard fastener comprised of a single piece of temperable sheet metal including a substantially T-shaped fastening and spacing structure, suitable for installation at the backs of wallboards to be joined together, and exposable to the wall cavity formed at least in part by the wallboards and framing members, having in a plane, a surface or surfaces of a panel abutting part or a plurality of such parts and in a parallel plane a surface or surfaces of a framing abutting part or a plurality of such parts, said planes being spaced apart by intermediate rigidizing walls, with the fasteners having arms of the T, or the cross-bar thereof, disposable behind a first wallboard panel and contactable with it, and the leg of the T such that it may extend beyond said first panel end to enable it to be mechanically fastened to a framing member, and with the arms of the T each having spaced web portions extending perpendicular thereto, fittable between the ends of abutting wallboard panels, and panel piercing portions extending from said web portions and partially covering the arms of the T, and being installable within the body of the wallboard panel at the end thereof.

* * * * *

UNITED STATES PATENT AND TRADEMARK OFFICE

CERTIFICATE OF CORRECTION

PATENT NO. : 4,296,580

DATED : October 27, 1981

INVENTOR(S) : Roger N. Weinar

It is certified that error appears in the above-identified patent and that said Letters Patent are hereby corrected as shown below:

On the title page, first column, between the headings [76] and [21] there should be inserted -- [*] Notice: The portion of the term of this patent subsequent to Oct. 3, 1995, has been disclaimed. --.

Column 2, line 32, "fasteners,of" should be -- fasteners of -- and "fasteners, and" should be -- fasteners and --.

Column 3, line 20, "wall" should be -- walled --.

Column 4, line 13, "inventon" should be -- invention --.

Column 4, line 23, "illustrating" should be -- illustrative --.

Column 4, line 58, "18 and 21" should be -- 19 and 21 -- and "16 and 19," should be -- 16 and 18, --.

Column 5, line 19, "insure" should be -- ensure --.

Column 6, line 22, "objectionally" should be -- objectionably --.

Column 7, line 55, "it and" should be -- it, and --.

Column 8, line 18, "comprising of at" should be -- comprising at --.

Column 8, line 19, "three of panels" should be -- three panels --.

Column 8, line 62, "end-butting" should be -- end-abutting --.

Column 9, line 53, "partialy" should be -- partially --.

UNITED STATES PATENT AND TRADEMARK OFFICE

CERTIFICATE OF CORRECTION

PATENT NO. : 4,296,580

DATED : October 27, 1981

INVENTOR(S) : Roger N. Weinar

It is certified that error appears in the above-identified patent and that said Letters Patent are hereby corrected as shown below:

Column 10, line 1, "member of a" should be -- member or a --.

Column 10, line 14, "of te tongue" should be -- of the tongue --.

Column 10, line 18, "substantialy" should be -- substantially --.

Column 10, line 21, "15" should be -- 18 --.

Column 10, line 29, "according t claim" should be -- according to claim --.

Column 10, line 35, "9" should be -- 15 --.

Signed and Sealed this

*Twenty-third* Day of *March 1982*

[SEAL]

*Attest:*

GERALD J. MOSSINGHOFF

*Attesting Officer*

*Commissioner of Patents and Trademarks*